US008087207B2

(12) United States Patent
Ghiringhelli

(10) Patent No.: US 8,087,207 B2
(45) Date of Patent: Jan. 3, 2012

(54) DECK SPACER

(76) Inventor: Joseph James Ghiringhelli, Rohnert Park, CA (US)

( * ) Notice: Subject to any disclaimer, the term of this patent is extended or adjusted under 35 U.S.C. 154(b) by 408 days.

(21) Appl. No.: 11/201,861

(22) Filed: Aug. 10, 2005

(65) Prior Publication Data

US 2005/0284056 A1 Dec. 29, 2005

Related U.S. Application Data

(62) Division of application No. 10/660,917, filed on Sep. 12, 2003, now Pat. No. 6,945,004.

(51) Int. Cl.
*E04H 12/00* (2006.01)

(52) U.S. Cl. ..... 52/650.3; 52/252

(58) Field of Classification Search ..... 52/650.3, 52/299, 707, 252; 411/179, 172, 187, 457; 301/35.631, 37.101
See application file for complete search history.

(56) References Cited

U.S. PATENT DOCUMENTS

| | | | | | |
|---|---|---|---|---|---|
| 899,972 | A | * | 9/1908 | Hammer | 256/65.06 |
| 2,058,020 | A | * | 10/1936 | Jaffe | 24/114.4 |
| 3,208,135 | A | * | 9/1965 | Newbold et al. | 29/432 |
| 3,216,171 | A | * | 11/1965 | Jenkins | 52/127.3 |
| 3,331,272 | A | * | 7/1967 | Hanneman | 411/369 |
| D219,768 | S | * | 1/1971 | Conwell | D8/354 |
| 3,649,079 | A | * | 3/1972 | English | 301/35.631 |
| 4,070,845 | A | * | 1/1978 | Cody | 52/632 |
| 4,165,904 | A | * | 8/1979 | Reppert | 301/35.631 |
| 4,412,407 | A | * | 11/1983 | Melfi et al. | 52/699 |
| 4,526,641 | A | * | 7/1985 | Schriever et al. | 156/247 |
| 4,793,335 | A | * | 12/1988 | Frey et al. | 623/13.14 |
| 4,867,472 | A | * | 9/1989 | Ward | 280/86.753 |
| 4,955,813 | A | * | 9/1990 | Fochler | 411/457 |
| D315,667 | S | * | 3/1991 | Johnson | D8/354 |
| 5,005,229 | A | * | 4/1991 | Bertoni | 4/505 |
| 5,108,156 | A | * | 4/1992 | Bell | 301/6.1 |
| 5,362,134 | A | * | 11/1994 | Carmona | 301/35.629 |
| 5,454,628 | A | * | 10/1995 | Maiworm et al. | 301/65 |
| 5,904,461 | A | * | 5/1999 | McKarge, Jr. | 411/302 |
| 5,918,707 | A | * | 7/1999 | Saunders, III | 188/18 A |
| D418,044 | S | * | 12/1999 | Schoeneweis | D8/354 |
| D442,197 | S | * | 5/2001 | Willet | D15/143 |
| 6,626,502 | B1 | * | 9/2003 | Petrak | 301/35.631 |
| 6,945,004 | B1 | * | 9/2005 | Ghiringhelli | 52/650.3 |
| D534,064 | S | * | 12/2006 | Gimpel et al. | D8/382 |

* cited by examiner

*Primary Examiner* — Basil Katcheves
(74) *Attorney, Agent, or Firm* — Stainbrook & Stainbrook, LLP; Craig M. Stainbrook

(57) ABSTRACT

An apparatus includes a predetermined size, shape, and thickness with a bolt hole adapted to receive a bolt therein and a method of attaching the apparatus to a ledger board sufficient to prevent rotation of the apparatus with respect to either the ledger board or the bolt hole. Modifications include securing the apparatus to the ledger board by the use of screws passing through a plurality of mounting holes provided in the apparatus or by the use of pointed protrusions that extend from the apparatus and which are pounded into the ledger board. Other modifications are described that include the use of intermediate shim spacers to vary the overall thickness of the spacer and of angled spacers for use with beveled types of siding.

7 Claims, 2 Drawing Sheets

DECK SPACER

This application is related to Provisional Patent Application No. 60/485,416 filed on Apr. 25, 2003 by the same applicant, the benefit of which is claimed.

BACKGROUND OF THE INVENTION

1. Field of the Invention

The present invention, in general, relates to building construction and, more particularly, to a spacer used to secure a ledger board distally with respect to a member of a structure that the deck is attached to.

When a deck is attached to a structure (i.e., a house), a supporting member (i.e., a ledger board) is attached to the house so that it is parallel with the structure. Joist hangers are typically attached to the ledger in spaced apart intervals, often at every sixteen or twenty-four inches. The joist hangers are used to hold one end each of a plurality of joists that extend away from the structure. The remaining opposite end of each joist is secured in any of a variety of well known ways. A decking material is then placed over the joists to provide a functional exterior deck surface.

The ledger is responsible for supporting the weight of one end of the deck and of securing that end to the structure.

The ledger cannot be attached directly to the structure because if it were so attached, water and debris would accumulate on top which would then hasten deterioration of the ledger board and also possibly damage the structure. Therefore, architects specify attaching the ledger board to the structure in ways that secure the ledger board away from the structure by an amount that typically is not less than one-quarter of an inch nor more than about one inch. This secures the deck to the structure, yet it prevents damage to the deck from the accumulation of water and debris.

As one of the most commonly specified ways of attaching the ledger to the structure is by the use of a plurality of bolts that pass through the ledger and the structure, most architects specify the use of a plurality of washers or shims that are disposed intermediate the ledger board and the structure through which each bolt then passes and is eventually tightened.

In actual use this is most difficult to accomplish. It is time consuming, even frustrating, to align the ledger board properly with respect to the structure, drill a plurality of holes at the proper locations along the ledger and through the structure, and then pass bolts through the outside of the ledger at each drilled location while also adding a specified number of washers (to obtain a desired spacing) over the end of each bolt intermediate the ledger and the structure.

The ends of the bolts are difficult to access to place the washers on and once this is accomplished the washers are apt to fall off the bolts before the bolts are aligned with and can enter into the drilled holes in the structure. The process of attaching a ledger to a structure in a spaced-apart configuration is a difficult and time consuming process. It also requires the presence of one or two helpers, therefore adding to the labor costs.

Also, beveled siding is often used on an exterior surface of a structure. The beveled siding provides an angle that is difficult to match. Depending on the location of the beveled siding that the ledger board is attached to, the distance varies from the beveled siding to a parallel and plumb ledger board. To date, there is no way to accommodate the angle of the beveled siding and no known way to accommodate the variation in depth other than by varying the number of washers that are used.

Accordingly, there exists today a need for an architectural deck spacer that helps overcome these problems and an accompanying method of attaching a ledger board to a structure.

Clearly, such an apparatus and method would be useful and desirable.

2. Description of Prior Art

Deck attachment devices are, in general, known. For example, the following patents describe various types of these devices:

U.S. Pat. No. 6,397,552 to Bourque, Jun. 4, 2002;
U.S. Pat. No. 5,201,156 to Newman, Apr. 13, 1993;
U.S. Pat. No. 5,058,358 to Stratton, Oct. 22, 1991; and
U.S. Pat. No. 4,953,339 to Jewell, Sep. 4, 1990.

While the structural arrangements of the above described devices, at first appearance, may have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide an architectural deck spacer that is useful in securing a ledger to a structure while maintaining the ledger a predetermined distance away from the structure.

It is also an important object of the invention to provide an architectural deck spacer that lessens the time required to properly secure a ledger to a structure.

Another object of the invention is to provide an architectural deck spacer that is economical to manufacture.

Still another object of the invention is to provide an architectural deck spacer that can be fabricated from a variety of materials.

Still yet another object of the invention is to provide an architectural deck spacer that is adapted to be attached to a ledger board.

Yet another important object of the invention is to provide an architectural deck spacer that is adapted to be attached to a ledger board and which includes a bolt hole therethrough.

Still yet another important object of the invention is to provide an architectural deck spacer that is adapted to be attached to a ledger board by at least two fasteners that are attached to and extend away from the spacer.

Still yet one other important object of the invention is to provide an architectural deck spacer that is adapted to be attached to a ledger board by at least two fasteners that pass through at least two openings in the spacer.

Still yet one remaining important object of the invention is to provide an architectural deck spacer that is adapted for use on beveled (i.e., angled siding).

Still yet one remaining especially important object of the invention is to provide an architectural deck spacer that is adapted for use on structures that include an uneven exterior surface (stucco, ship lap, etc.) when a variable distance from the surface to a ledger board results in a need to provide a variable thickness of a spacer in order to maintain a plumb orientation for the ledger board.

Briefly, a spacer that is constructed in accordance with the principles of the present invention has a predetermined three dimensional shape. A bolt hole is provided for a bolt to pass through. At least two fasteners that are distally located with respect to the bolt hole are used to secure the deck spacer to a ledger board. The fasteners include screws that pass through countersunk mounting holes in the deck spacer or they may extend away from the deck spacer and be adapted for forced entry (i.e., hammered) into the ledger board. A plurality of the deck spacers are then attached to the ledger board. The bolts holes provide a guide (i.e., a pilot) as to where to drill the holes through the ledger board and then through an exterior portion of a structure. The deck spacers cannot move or rotate once they have been attached to the ledger board. For beveled siding, an angled type of spacer is provided. A plurality of shim spacers are placed intermediate the spacer and the ledger board to accommodate uneven surfaces. According to a modification, a thread is provided in a modified threaded spacer to which threads of the bolt are adapted to cooperate. The threaded spacer can be secured to the inside of the structure (after drilling the holes). The bolts are then passed from the outside of the structure, through the ledger board, and tightened.

DETAILED DESCRIPTION OF THE INVENTION

Figure 1:
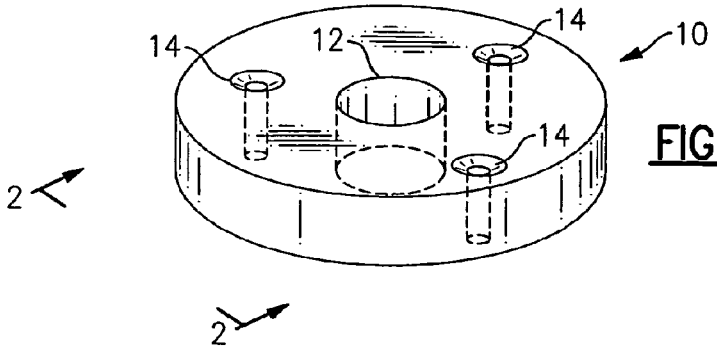
FIG. 1 is a view in perspective of a spacer.
Figure 2:
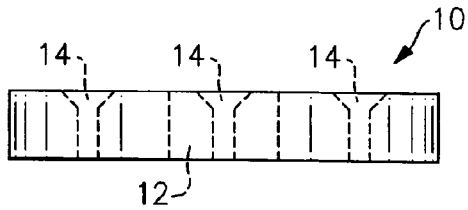
FIG. 2 is a view taken along the line 2-2 in FIG. 1.

Referring on occasion to all of the figure drawings and in particular now to FIG. 1, is shown a spacer, identified in general by the reference numeral 10.

The spacer 10, as shown, includes a predetermined size and shape. The preferred shape is circular with a predetermined thickness. For example, a diameter of at least two inches with a thickness of at least one-eight of an inch is required for the spacer 10. However, a diameter of two and one-half inches and a thickness of one-half of an inch is preferred most applications of the spacer 10. The smaller thickness (one-eight of an inch) is used for a special shimming purpose and is described in greater detail hereinafter.

Figure 4:
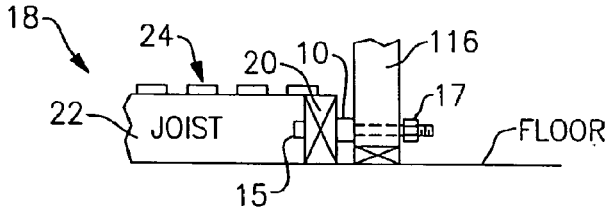
FIG. 4 is a side view of the spacer of either FIG. 1 or FIG. 3 used to secure a ledger board to a structure.

Referring momentarily now also to FIG. 4, the spacer 10 includes a center bolt hole 12. A preferred diameter for the center bolt hole 12 is sufficient to allow a one-half inch diameter bolt 15 to pass freely through the spacer 10. The bolt 15 is used to secure a ledger board 20 to a structure 16 and its use is also described in greater detail hereinafter.

The spacer 10 includes a plurality of mounting holes 14 that are used to secure the spacer to the ledger board 20 (or the structure 16). The mounting holes 14 are counter sunk and accept wood screws or other types of screws or fasteners (not shown).

In use, a plurality of the spacers 10 are attached to one side of the ledger board 20 along its longitudinal length at predetermined desired intervals (as are commonly known or which are specified by an architect). The spacers 10 are preferably staggered above and below a longitudinal centerline as well as on the centerline of the ledger board 20, as desired.

Wood screws, nails, or other fasteners, are placed in the mounting holes 14 and are used to attach the spacers 10 to the ledger board 20 where desired. At least two mounting holes 14 are provided through the spacer 10. The mounting holes 14 are located away from the center bolt hole 12 and at least two fasteners are used that pass through each of the mounting holes 14. Two mounting holes 14 with fasteners are minimally required to secure each of the spacers 10 to the ledger board 20 sufficient to prevent rotation or other movement of the spacers 10 with respect to the ledger board 20.

Once the required number of spacers 10 have been attached to the ledger board 20, a drill (not shown) is used to drill a bolt hole through the ledger board 20 at each location that aligns with the bolt hole 12 of each of the attached spacers 10. This is easily and rapidly accomplished by using each of the bolt holes 12 as a pilot hole to place a drill bit (not shown) and drill the holes through the ledger board 20.

The ledger board 20 is then placed adjacent to the structure 16 and is adjusted and moved until properly located so that it is at the correct height and is level. A couple of nails are used to lightly secure the ledger board 20 (i.e., to tack the ledger board 20) in place. If help is available, the ledger board 20 is temporarily held in place adjacent the structure 16. In either case, the previously drilled holes through the ledger board 20 and the bolt holes 12 in the spacers 10 are now used as pilot holes to drill mounting holes into and through an exterior wall of the structure 16.

If help is available and the interior of the structure 16 is readily accessible, one each of the bolts 15 is passed through each of the holes through the ledger board 20 and into the structure 16. A nut 17 is threaded on the end of each bolt 15 inside of the structure. Each bolt 15 is tightened to a desired range of torque sufficient to properly retain the ledger board 20 to an exterior wall (surface) of the structure 16. This is repeated at each spacer 10 location.

A first end of a plurality of joists 22 are each attached to the ledger board 20, either by nails or screws or by the use of joist hangers, any of which are well known in the deck building arts and not shown. An opposite second end of each of the joists 22 are supported by any of a variety of well known methods as well. A plurality of deck boards 24 are attached to the tops of the joists 22 to provide a completed surface for the deck 18.

The spacers 10 maintain the ledger board 20 a predetermined distance away from the structure (i.e., the thickness of the spacers 10). This prevents water from accumulated on the ledger board adjacent to the structure 16. Instead, water as well as small debris falls down around the spacers 10 through the space provided to a location that is beneath the ledger board 20. If water were to accumulate, over time it would cause damage to the ledger board 20, the structure 16, or both. The ledger board 20 is essential to the design, function, and safety of a deck, the deck being identified in general by reference numeral 18.

The spacers 10 not only provide the required spacing, but they also serve as a pilot to quickly drill the bolt holes through the ledger board 20 at the proper location and also through the structure 16.

The spacers 10 can be modified to include any preferred shape other than circular, for example square, rectangular, triangular, or other polygonal shape.

The size or diameter affects the bearing area on each opposite planar side of the spacer 10 and therefore the pressure in pounds per square inch that the surface (side) of each spacer 10 experiences. A larger diameter (or surface area) for the spacer 10 allows it to withstand a greater pressure without excessively embedding into either the ledger board 20 or the structure 16.

Accordingly, the surface area of the spacer 10 is chosen to correspond ideally with the materials used for the ledger board 20 and the structure 16. A soft wood, for example, requires a greater surface area for the spacer 10 than does a hardwood. Of course, the spacer 10 can be designed so as to include a surface area sufficient for most applications that are likely to occur thereby providing one size of the spacer 10 that is suitable for most applications. If desired, the surface area of one side can be less or more than the surface area of the opposite side.

Figure 3:
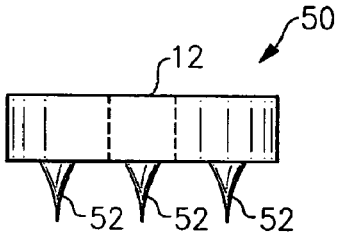
FIG. 3 is a side view of a first modified spacer with an alternate attachment.

Referring now also to FIG. 3, a first modified spacer 50 is used. The first modified spacer 50 includes the center bolt hole 12 of the spacer. A plurality (at least two) pointed protrusions 52 are attached to and extend from one planar side of the first modified spacer 50. As shown, three pointed protrusions 52 are radially spaced equidistant from each other and also from the center bolt hole 12.

The first modified spacer 50 is attached to the ledger board 20 by placing the pointed protrusions 52 against the ledger board 20 and then pounding the first modified spacer 50 with a hammer so that the pointed protrusions 52 enter into the ledger board 20 and secure the first modified spacer 50 to the ledger board 20. This process is repeated for all of the first modified spacers 50 that are to be used. Once the first modified spacers 50 are attached to the ledger board 20, the holes in the ledger board 20 and into the structure are drilled as was previously described.

Having at least two pointed protrusions 52, and preferably three, prevents rotation or other movement of the first modified spacer 50 on the ledger board 20. It is important that such rotation not occur, otherwise the center bolt hole 12 would move relative to the ledger board 20. This would make it difficult to impossible to pass bolts through the spacer 10 or first modified spacer 50 from the outside of the ledger board 20 (on an opposite side where the spacer 10, 50 is not accessible).

While any suitable material including metals can be used for any of the spacers 10, 50 (or others as later described), plastic is preferred. For the first modified spacer 50, the pointed protrusions 52 are either formed (i.e., molded) as an integral part of the first modified spacer 50 or they are molded into the first modified spacer 50.

For example, the pointed protrusions 52 can be formed of a metal and molded part way into a plastic type of the first modified spacer 50 sufficient to retain them in position while allowing the pointed ends to extend therefrom. Alternatively, the first modified spacer 50 and the pointed protrusions 52 can all be formed of a metal.

Figure 5:
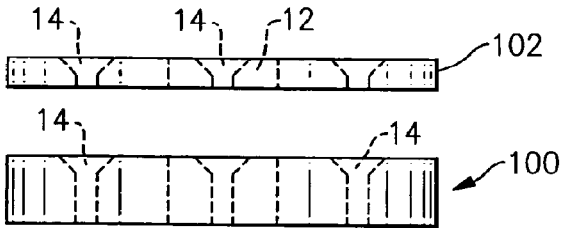
FIG. 5 is a side view of a second modified spacer and intermediate shim spacer used with beveled siding.

Referring now also to FIG. 5, if the outside of the structure 16 includes beveled siding or an uneven surface (for example, a stucco finish), then both the angle and the thickness of the spacer 10 may need to be varied. To accomplish this, a second modified spacer 100 is provided that is similar to the spacer 10 except a cross section reveals that it includes an angle with respect to a first and a second opposite planar side thereof. The angle is selected to match the taper angle of most common types of beveled sidings (not shown).

Accordingly, the thickness of the second modified spacer 100 is greater at one end than at an opposite end. The second modified spacer 100 is attached to an upper portion of the ledger board 20 so that the thicker end is up (toward the deck boards 24) and the thinner end is down (away from the deck boards 24). This ensures that the thicker portion of the second modified spacer 100 aligns with a thinner portion of the beveled siding thereby compensating for the thinner portion of the beveled siding and providing a plumb surface to properly secure the ledger board 20.

The second modified spacers 100 are also attached at various places along the ledger board 20, some higher and some lower. The higher ones must overcome a greater disparity in thickness as the beveled siding tapers to greater extend than at a lower location of the beveled siding. Accordingly, the second modified spacers 100 require a different overall thickness, depending upon where they are attached to the ledger board 20 and how they align with the beveled siding underneath.

To accommodate this, a plurality of intermediate shim spacers 102 (only one is shown) are used and are placed in atop the second modified spacer 100 and between the structure 16 as needed sufficient to retain the ledger board 20 plumb. The second modified spacer 100 is used where the beveled siding is thickest. The intermediate shim spacers 102 are added (as many as required) wherever the beveled siding is thinner (and therefore further away from the ledger board 20).

The intermediate shim spacers 102 include the center bolt hole 12 and the mounting holes 14 and therefore align properly with the second modified spacer 100. The screws used to retain the second modified spacer 100 also retain the intermediate shim spacers 102 in position. Longer screws may, of course, be needed.

If desired, the intermediate shim spacers 102 also align with and therefore can also be used with the spacers 10 (that include parallel opposite surfaces) to provide a variable thickness (i.e., depth) for surfaces that are parallel and plumb but which include variations in depth. This can occur for any number of reasons, for example, trim material (not shown) may be added to the outside of the structure 16 that protrudes from the normal surface. The use of the intermediate shim spacers 102 and the spacers 10 eliminate the need to remove the trim material. This also facilitates the speed of installation.

Many modifications are also possible. For example, recesses can be provided in one or both sides of any of the spacers 10, 50, 100. The recesses can serve a variety of purposes. They save material during formation of the spacers 10, 50, 100 and are useful in increasing the pressure (in pounds per square inch) by which the spacers 10, 50, 100 attach to the ledger board 20 or the structure 16. This helps set them better in position, lessening the chances of settling. This is important because it decreases the chances that over time, the deck 18 will loosen or creak when a person walks on the deck boards 24. Accordingly, the finished deck will appear to have more quality over a longer period of time than if other attachment means were utilized. If the recesses extend across the width of any of the spacers 10, 50, 100, they also act as a channel to allow water to pass.

Figure 6:
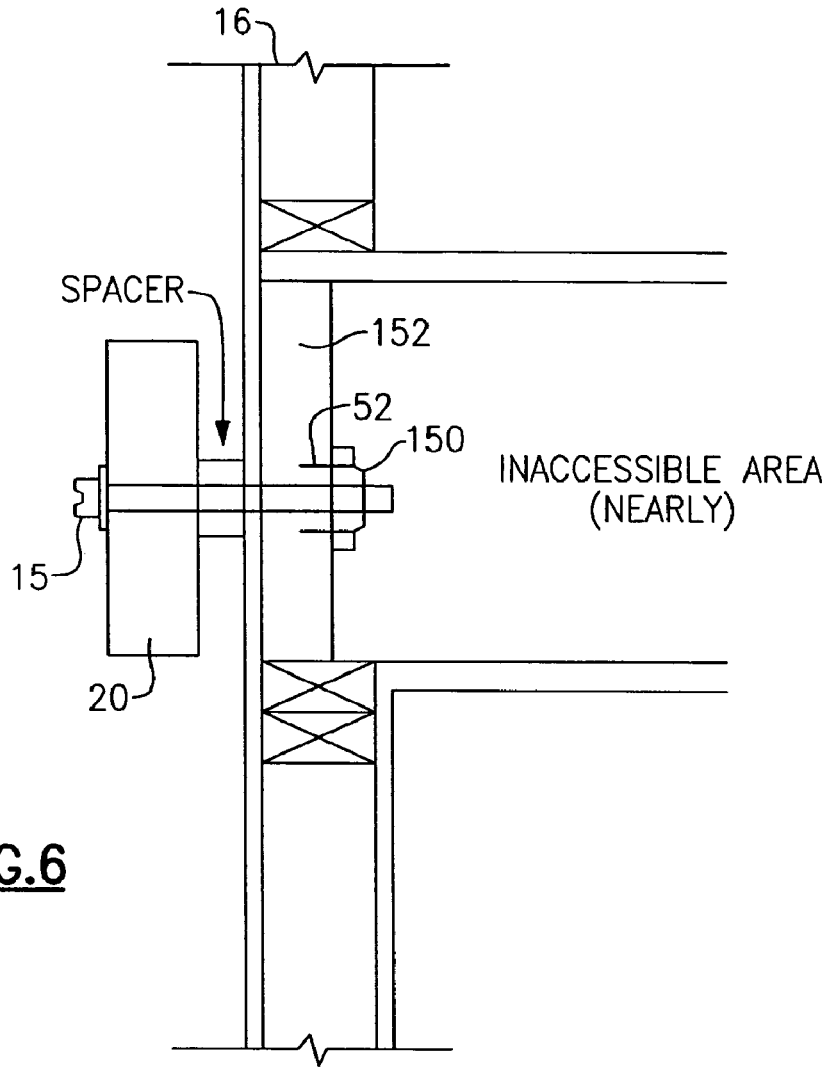
FIG. 6 is a side view of a second modified spacer with an alternate attachment and threaded means.

Referring now also to FIG. 6, a third modified spacer 150 is shown. When the inside of the structure 16 is difficult to access or if help is not available to prevent the nut 17 (FIG. 4) from rotating when the bolt 15 head is tightened from the outside of the structure 16, the third modified spacer 150 is preferred.

The third modified spacer 150 also includes the pointed protrusions 52, as previously described. The third modified spacer 150 however, does not include the standard bolt hole 12. Rather, a smaller opening is provided in the center and is tapped with a thread pattern that matches and cooperates with the thread pattern of an end of the bolt 15.

In use, after the holes are drilled through the ledger board 20 and the structure 16, the third modified spacer 150 is pounded into an interior member 152 of the structure 16 over each of the holes that have been drilled through the ledger board 20 and into the structure.

The third modified spacer 150 covers each hole on an inside of the structure 16. When the bolts 15 are then inserted from the outside of the structure 16 through the ledger board 20 and into the structure 16, the threaded bolt 15 ends contact each of the third modified spacers 150 on an inside of the structure.

The bolts 15 are then turned (i.e., rotated) from the outside so as to engage the threads in each of the third modified spacers 150. The bolts 15 are tightened from the outside sufficient to properly secure the ledger board 20 to the structure 16. The pointed protrusions 52 prevent the third modified spacer 150 from rotating and allow tightening of the bolts 15 from the outside. Only one person is required to accomplish the entire process.

The third modified spacer 150 functions in one capacity as a special type of a nut that cannot rotate. The third modified spacer 150 serves a dual purpose in that it can also be used with smaller diameter bolts (not shown) that do not engage with the center threads but rather pass through them. Therefore the third modified spacer 150 can be used in the same manner as the first modified spacer 50, but with the smaller diameter bolt to secure the ledger board 20 a predetermined distance away from the structure 16.

Accordingly, the third modified spacer 150, if used, can function both as a non-rotating type of a nut for use with the larger diameter bolt 15 or as variation of the first modified spacer 50 for attachment directly to the ledger board 20 when used with the smaller diameter bolt.

Figure 7:
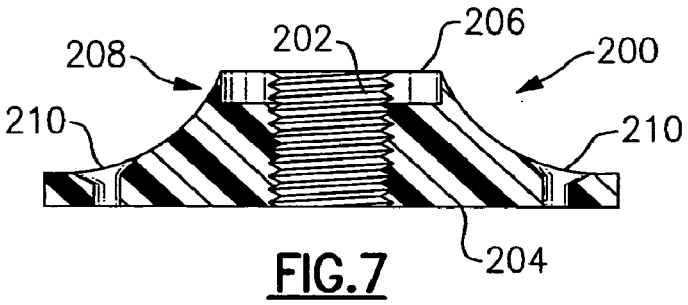
FIG. 7 is a cross-sectional view of a fourth modified spacer with a threaded center opening.

Referring now to FIG. 7 is shown a cross-section of a fourth modified spacer 200 that includes a threaded interior 202 that is similar to that of the third modified spacer 150 and is adapted to cooperate with the threads of the bolt 15.

The fourth modified spacer 200 includes a larger diameter bottom plane 204 and an opposite smaller plane 206. The opposite plane 206 preferably includes hex shape, identified in general by the reference numeral 208, which is provided for ease of tightening.

A plurality of modified mounting holes 210 are provided for attachment to the ledger board 20 or to the interior member 152 of the structure 16 by the use of screws (not shown).

Accordingly, the fourth modified spacer 200 can be used in virtually all applications. It can be used in identical fashion to that of the third modified spacer 150. If the screws are not used, it can be tightened by using the hex shape 208 on the opposite plane 206. After tightening, the screws can be passed through the modified mounting holes 210 to ensure that it can never loosen.

Similarly, the screws can be used to prevent the fourth modified spacer 200 from rotating and then, as was previously described for the third modified spacer 150, the bolts 15 can be passed through the ledger board 20 and rotated so as to engage with the fourth modified spacer 200 and secure the ledger board 20 to the structure 16.

If desired, the bolt 15 can be passed in from the inside of the structure 16, out through the ledger board 20 where the fourth modified spacer 200 is used to engage with its threads. If a helper is available on the inside of the structure 16 to prevent rotation of the bolt 15, then the fourth modified spacer 200 can be tightened from the outside using the hex shape 208.

The fourth modified spacer 200 can be used exactly the same as the spacer 10 if the smaller diameter bolt is used that does not engage with the threads 202 of the fourth modified spacer 200 but instead passes through the threads 202. In this instance, the hex shape 208 provides a smaller bearing area that can be used to provide the proper spacing in between the ledger board 20 and the structure 16 providing the smaller diameter bolt is not excessively tightened.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A ledger board spacing system for exterior deck installations, said system comprising:

a ledger board;

a plurality of plastic spacers, each of said spacers including a first board engaging side and an opposite second board engaging side and including a predetermined size, shape, and thickness, and wherein said spacers do not include any portion attached thereto that extends beyond said first planar side or beyond said second planar side, wherein each of said spacers include a bolt opening adapted to receive a bolt therein and that does not include any threads able to threadably engage with any threads of said bolt and attachment means spaced apart from said bolt hole for attaching one of said plurality of spacers to said ledger board and for preventing said spacer from rotating with respect to said bolt opening; and a plurality of bolts, one each for slidable passage through a bolt hole of one of said plurality of spacers for partly supporting and connecting said ledger board on a structural member of a building structure;

wherein when using said attachment means to attach a plurality of said spacers to said ledger board in a spaced apart relationship on or generally staggered across the longitudinal centerline of said ledger board, said bolts holes serve as pilot holes for drilling holes in both said ledger board and the structural member to which said ledger board is being attached, such that said bolt holes are accurately and reliably aligned with the holes in both the ledger board and the structural member, and wherein said plurality of spacers cannot move or rotate after attachment to said ledger board.

2. The system of claim 1 wherein said attachment means includes a plurality of mounting holes through said spacer, said mounting holes each adapted to receive a fastener, said fastener adapted to secure said spacer to said member.

3. The system of claim 2 wherein said plurality of mounting holes includes three mounting holes that are equidistant with respect to said bolt hole and wherein said bolt hole is disposed proximate a geometric center of said spacer.

4. The system of claim 3 wherein said predetermined shape includes a substantially cylindrical shape and wherein said bolt opening passes through a center thereof.

5. The system of claim 1 wherein said first board engaging side is parallel with respect to said second board engaging side.

6. The system of claim 5 including an intermediate shim spacer adapted for placement adjacent to said spacer sufficient to increase an overall thickness of said spacer and wherein said intermediate shim spacer has a first planar surface and a parallel opposite second planar surface and wherein said intermediate shim spacer includes a modified bolt opening and a modified means for attaching, and wherein when said intermediate shim spacer is disposed adjacent to said spacer, said modified bolt opening and said modified means for attaching align with said bolt opening and said attachment means respectively.

7. The system of claim 5, further including a plurality of intermediate shim spacers, each adapted for placement between one of said plurality of spacers and the ledger board, wherein each of said intermediate shim spacers has a first planar side which in installation is approximated to one of said planar sides of said spacer and a second planar side which is beveled or angled in relation to said first planar side, and a central bolt hole which is aligned with said bolt hole of one of said spacers.

* * * * *